United States Patent [19]

Nazet et al.

[11] 4,358,706

[45] Nov. 9, 1982

[54] INSULATED COLLECTOR FOR AN ELECTRONIC POWER TUBE AND A TUBE EQUIPPED WITH SUCH A COLLECTOR

[75] Inventors: René Nazet; Pierre Ribout, both of Paris, France

[73] Assignee: Thomson-CSF, Paris, France

[21] Appl. No.: 154,273

[22] Filed: May 29, 1980

[30] Foreign Application Priority Data

May 31, 1979 [FR] France ..... 79 13982

[51] Int. Cl.[3] ..... H01J 23/02

[52] U.S. Cl. ..... 315/5.38; 315/3.5

[58] Field of Search ..... 315/5.38, 3.5, 3.6, 315/39.3

[56] References Cited

U.S. PATENT DOCUMENTS

| | | | |
|---|---|---|---|
| 3,626,230 | 12/1971 | Stewart | 315/5.38 |
| 3,662,212 | 5/1972 | Rawls, Jr. | 315/5.38 |
| 3,717,787 | 2/1973 | Doyle | 315/5.38 |
| 3,823,772 | 7/1974 | Lavering et al. | 315/5.38 |
| 3,881,547 | 5/1975 | Lavering | 315/5.38 |
| 4,054,811 | 10/1977 | Huber et al. | 315/5.38 |

FOREIGN PATENT DOCUMENTS

| | | | |
|---|---|---|---|
| 1349152 | 12/1963 | France | 315/5.38 |

*Primary Examiner*—Saxfield Chatmon, Jr.
*Attorney, Agent, or Firm*—Roland Plottel

[57] ABSTRACT

The collector of an electronic power tube is surrounded by a ceramic sleeve and a heat-sink. Between these three parts two resilient assemblies, are placed respectively one having anchorage points on the collector and the ceramic sleeve, and the other having anchorage points on the ceramic sleeve and the heat-sink. The two assemblies are formed from pieces able to be deformed both in the cross-sectional planes and along the axis of the system.

7 Claims, 12 Drawing Figures

INSULATED COLLECTOR FOR AN ELECTRONIC POWER TUBE AND A TUBE EQUIPPED WITH SUCH A COLLECTOR

BACKGROUND OF THE INVENTION

The invention relates to an insulated collector for electronic power tubes and a tube equipped with such a collector. It is known that the collectors of electronic tubes receive, at the end of their travel, the electrons of the beam. The result is that for physical reasons they are often brought up to high absolute value potentials. Moreover, the impact of the electrons necessarily produces heat.

The problem is to provide both cooling for this collector and the electrical insulation thereof, this the latter for safety reasons.

Now, the electrical insulation can only be carried out by means of insulating pieces, for example, ceramic pieces.

Furthermore, the devices for radiating the heat are generally metallic. This then leads to placing ceramic pieces or other insulators between the collector and the heat-sink. The assembly is then formed of materials not having the same thermal expansion coefficients; which poses problems of mechanical stresses during operation.

The invention provides an electron collector and its cooling device in which these problems of stresses are avoided.

SUMMARY OF THE INVENTION

The insulated collector for power tubes of the invention is of the type having two heat-conducting assemblies, the first connecting the live part of the collector to an insulating piece, the second connecting the insulating piece to the heat-sink. These two assemblies are formed from parts which are deformable both in a cross-sectional plane of the collector and along the axis thereof, having alternate anchorage points respectively on the insulating piece and on the collector for the first assembly; and on the insulating piece and on the heat-sink for the second assembly, these pieces being dimensioned so that they offer low resistance to the heat flow.

The invention will be better understood from the following description made with reference to the accompanying drawings.

DESCRIPTION OF THE PREFERRED EMBODIMENTS

Figure 1:
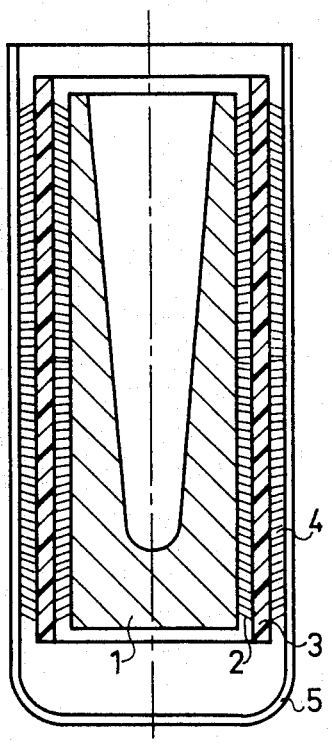
FIG. 1 is a schematical view in longitudinal section of the device of the invention.

FIG. 1, shows a vacuum tube, for example, a progressive-wave tube having a collector 1. This collector has a copper enclosure in the form of a tube hollowed out in its central part, which has the shape of a cone of revolution around the axis of the tube, which is also the axis of the electronic beam when the tube is operating.

A first resilient assembly 2 is brazed to the outer surface of the tube, which will be described further on. This assembly 2 is brazed to the inner part of a ceramic tube 3. The outer face of this tube 3 is brazed to a second resilient assembly 4 which supports a copper piece 5, which ensures the cooling of the collector. This device has for axis of revolution the axis of the collector.

As shown heat-sink 5 is electrically disconnected from collector 1 and may be to ground, whatever the potential of the collector.

In operation, collector 1 tends to heat up by absorption of the electrons. Its thermal expansion coefficient is different from that of the ceramic 3. The same goes for heat-sink 5. Thus, during operation the two assemblies 2 and 4 have to then withstand the stresses which result.

The invention enables an assembly to be constructed capable of withstanding these stresses.

Figure 3:
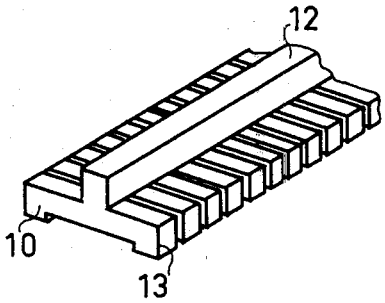
FIGS. 2, 3 and 4 show a first embodiment of the resilient pieces.
Figure 2:
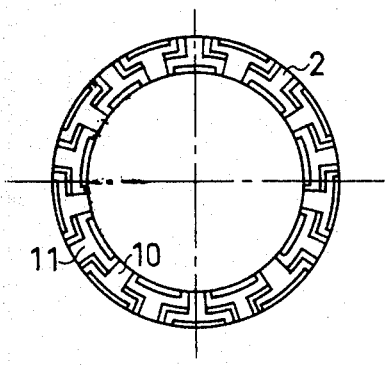
Figure 4:
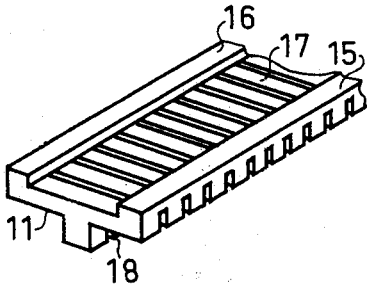

FIG. 2 and FIGS. 3 and 4 show respectively a cross-section and partial views of a first embodiment of the first or of the second assembly.

In FIG. 2 assembly 2 is shown in section. It is formed from two series of pieces 10 and 11, which extend parallel to the axis of the collector.

All the pieces cover the inner face of the ceramic and the outer face of the collector.

One piece 10 is shown in FIG. 3. It has a backbone 12. This backbone carried bars 13 (backbone and bars may form a monobloc assembly or be assembled brazed). The backbone is brazed to the collector and the bars to the ceramic.

Piece 11 comprises identical side members 15 and 16. Each of these side members is connected to the other by an array of cross-pieces 17 separated from each other by so-called "flexibility" slits 18 which extend into the side members.

The assembly is resilient and may be deformed in length in the direction of the generatrix, or under compression in the plane of the cross-section.

Pieces 10 and 11 fit together in the way shown in FIG. 2, the backbones and the side members 15 and 16 being brazed to the collector.

Assembly 4 is similar to assembly 2. It should be noted that when one of the assemblies works under compression the other works under extension.

Figure 5:
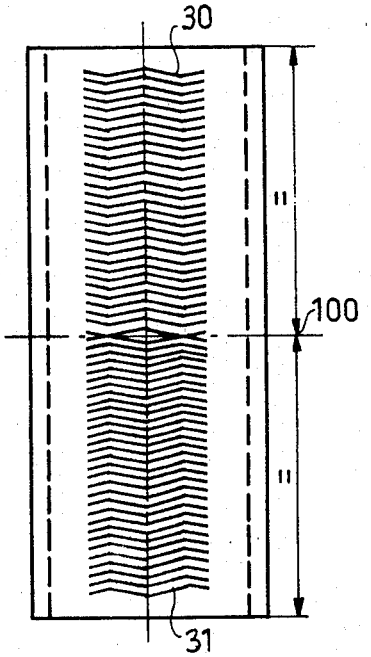
FIG. 5 is a side view, a second embodiment.
Figure 6:
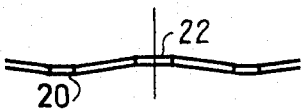
FIGS. 6, 7 and 8 are partial views of elements forming the assembly of FIG. 5.

In FIG. 5 is a side view of another embodiment of assembly 2.

Assembly 4, as in the previous case, is formed in a similar way. But whereas one works under compression, the other works under extension and vice versa.

Assembly 2 is formed from flexible mechanical elements 20 extending essentially in the cross-sectional plane of the cylinder which forms the outer surface of collector 1. Each element has a succession of fasteners brazed alternately to points 21 on collector 1 and to points 22 on ceramic 3, the whole forming a broken line. These elements are arched, as shown in FIG. 5, in a first direction for elements 30 and in the opposite direction for elements 31. Plane 100 is essentially the median plane of the collector. This arrangement divides by two the longitudinal deformations of the elements.

Figure 7:
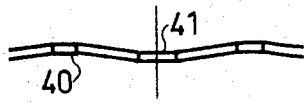

FIG. 7 similarly shows one element of assembly 4, whose fasteners bear on ceramic sleeve 3 and heat-sink 5 and are brazed at 41 and 42 respectively to the ceramic 3 and heat-sink 5.

Figure 8:
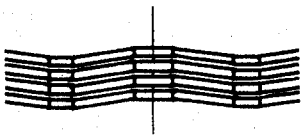

FIG. 8 is a side view of a portion of assembly 2.

Figure 9:
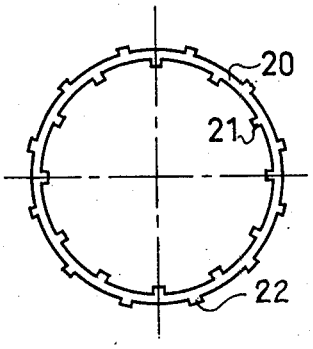
FIGS. 9, 10 and 11 are top views of the same elements.
Figure 10:
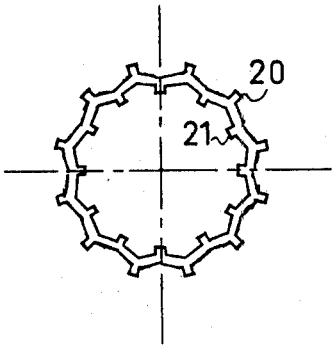
Figure 11:
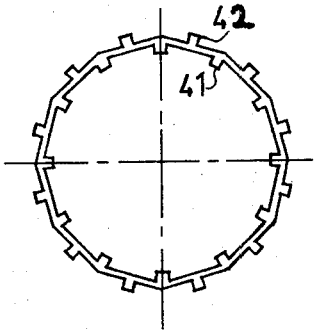

FIG. 9 shows a top view of an element of assembly 2, or of assembly 4. Before brazing, this element is circular and the anchorage points 21 and 22, can be clearly seen.

At the time of brazing, or during operation, cylinder 1 expands more than piece 3 of the ceramic. Points 21 move away from the circumference and the assembly forms two polygons.

The same phenomenon, takes place for assembly 4 of FIG. 1, but in the opposite direction. Points 41 are anchored to ceramic 3 which remain fixed, and points 42 are anchored to copper 5 which tend to move away from each other.

Figure 12:
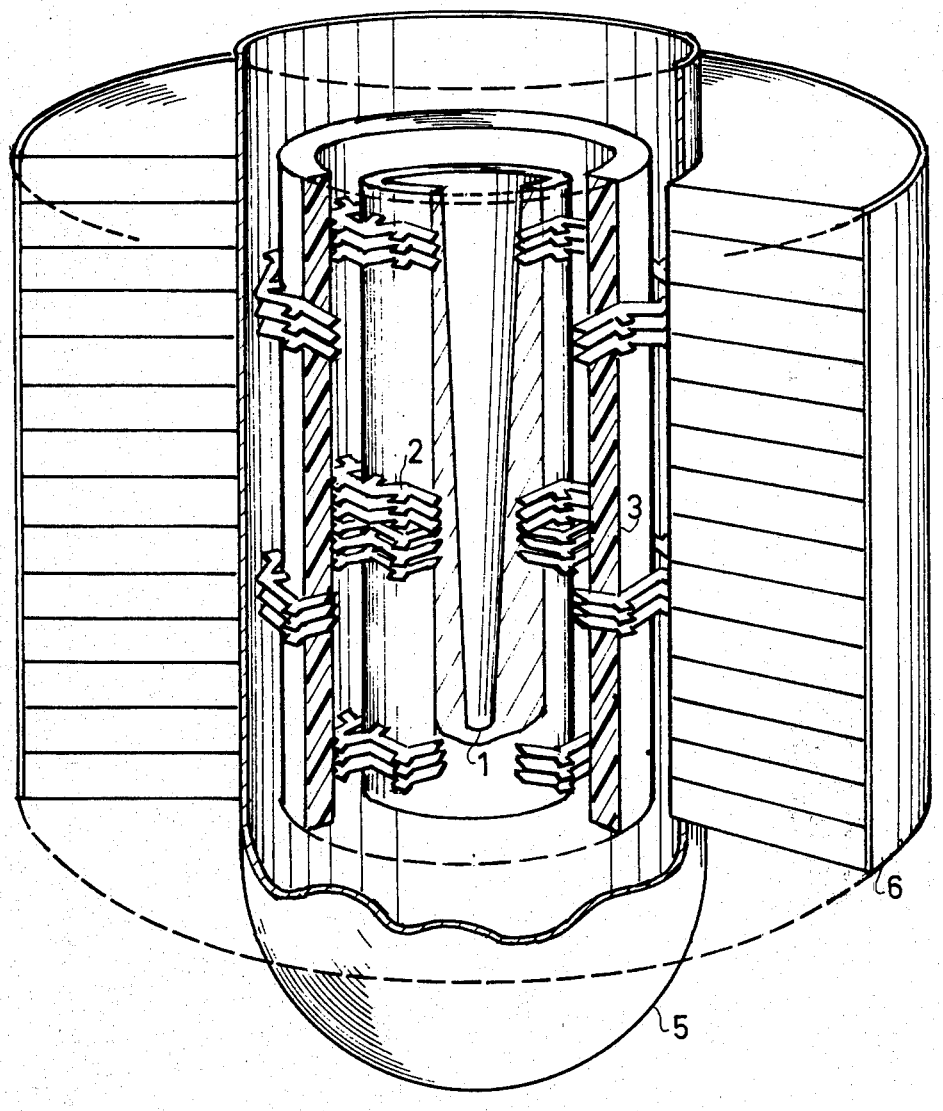
FIGS. 12 is a perspective view with parts cut away of the assembly of FIG. 5.

FIG. 12 shows the assembly with collector 1, insulator 3, heat-sink 5 and pieces 2 and 4 in perpective with parts cut away.

The assembly is surrounded by fins 6.

Of course, the invention may be applied to all electronic power tubes where the collector is not grounded.

What is claimed is:

1. An insulator electron collector assembly for electronic tubes, comprising two metal parts concentrically disposed along an axis, forming respectively an inner collector and an outer sleeve and further comprising a third part made of insulating material located therebetween, a first series of resilient members located between said inner collector and said third part, a second series of resilient members located between said third part and said outer sleeve, said resilient members consist of elements stacked in the direction of said axis, and which elements comprise on both sides interdigitated projecting parts distributed on the periphery of the elements by which they rest against the parts between which they are located.

2. An insulator electron collector assembly as claimed in claim 1, wherein said elements are thin metal washers.

3. An insulator electron collector assembly as claimed in claim 1, wherein said elements consist of two different sets of linear parallel bars, the bars of one set (10, FIG. 3) being fastened together on one side by a projecting backbone at right angle with respect to said bars, and having a central recess on the opposite side, the bars of the other set (11, FIG. 4) being fastened together on one side at their extremities by two backbone at right angle with respect to said bars and having on the other side a projecting part at their center, said different sets fitting together, alternating, with their backbones parallel to the axis and resting against the metal parts.

4. An insulator electron collector assembly as claimed in claim 1 wherein said projecting parts are soldered to the parts against which they rest.

5. An insulator electron collector assembly for electronic tubes, comprising two metal parts concentrically disposed along an axis, forming respectively an inner collector and an outer sleeve; a third part made of insulating material located therebetween; a first series of resilient members located between said inner collector and said third part; a second series of resilient members located between said third part and said outer sleeve; said resilient members comprising elements stacked in the direction of said axis, and which elements comprise on both sides projecting parts distributed on the periphery of the elements by which they rest against the parts between which they are located, the resilient members of each series are constituted by two different sets of resilient members, each comprising, along generatrices of cylinders having for axis the axis of said resilient members, bars, a backbone and flexible slits in which the flexible slits separate parts of bars in the first set of resilient members and parts of backbone in the second set of resilient members.

6. An insulator electron collector assembly as claimed in claim 5, wherein said resilient members of two set have said bars linear and parallel to one another, the bars of one set of members being fastened together on one side by a projecting backbone at right angle with respect to said bars and having a central recess on the opposite side; the bars of the other set of members being fastened together on one side at their extremities by two backbones at right angle with respect to said bars and having on the other side a projecting part at their center; said resilient members being fitted together so that the resilient members of one set alternate with the resilient members of the other set, with their backbones parallel to the axis.

7. An insulator electron collector assembly for electronic tubes, comprising two metal parts concentrically disposed along an axis, forming respectively an inner collector and an outer sleeve, a third part made of insulating material located therebetween; a first series of resilient members located between said collector and said third part; a second series of resilient members located between said third part and said outer sleeve; said resilient members comprising elements stacked in the direction of said axis, and which elements comprise on both sides projecting parts distributed on the periphery of the elements by which they rest against the parts between which they are located; the resilient members having at a predetermined temperature the shape of circular washers; said resilient members extending in the cross sectional plane of the collector with the washers being arched in one direction on one half of the length of the collector and in the other direction on the other half.

* * * * *